US007190117B2

(12) United States Patent
Rosenbauer

(10) Patent No.: US 7,190,117 B2
(45) Date of Patent: Mar. 13, 2007

(54) INCANDESCENT LAMP HAVING A CARBIDE-CONTAINING LUMINOUS ELEMENT

(75) Inventor: Georg Rosenbauer, Wassertrudingen (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 0 days.

(21) Appl. No.: 11/081,734

(22) Filed: Mar. 17, 2005

(65) Prior Publication Data

US 2005/0212422 A1 Sep. 29, 2005

(30) Foreign Application Priority Data

Mar. 23, 2004 (DE) ..... 10 2004 014 211

(51) Int. Cl.
*H01K 1/40* (2006.01)
*H01K 1/20* (2006.01)
*H01K 1/04* (2006.01)

(52) U.S. Cl. ..... 313/578; 313/344; 313/345; 313/315

(58) Field of Classification Search ..... 313/578–580, 313/315, 341–345
See application file for complete search history.

(56) References Cited

U.S. PATENT DOCUMENTS 2,596,469 A 5/1952 Cooper
3,022,438 A 2/1962 Cooper
3,136,039 A * 6/1964 Keith ..... 75/243
3,237,284 A * 3/1966 Bird ..... 445/48
3,247,417 A * 4/1966 Stute et al. ..... 313/578
3,355,619 A 11/1967 Reed
3,405,328 A 10/1968 Johansen et al.
4,052,637 A * 10/1977 Op de Beeck ..... 313/578
4,155,758 A 5/1979 Evans et al.
5,034,656 A * 7/1991 Yu et al. ..... 313/579
5,528,105 A * 6/1996 Brinn et al. ..... 313/518
5,548,182 A 8/1996 Bunk et al.
5,811,934 A 9/1998 Bunk et al.
6,017,258 A * 1/2000 Sakurai et al. ..... 445/32
6,194,832 B1 2/2001 Juengst

* cited by examiner

*Primary Examiner*—Ashok Patel
*Assistant Examiner*—Christopher M. Raabe
(74) *Attorney, Agent, or Firm*—William E. Meyer

(57) ABSTRACT

The incandescent lamp is equipped with a luminous element which is hermetically inserted in a bulb together with a filling, the luminous element having a metal carbide whose melting point is above that of tungsten. The supply lead is fabricated integrally with the luminous element from a wire and provided with an electrically conducting coating which decisively improves the impact strength and make-proofness.

12 Claims, 2 Drawing Sheets

INCANDESCENT LAMP HAVING A CARBIDE-CONTAINING LUMINOUS ELEMENT

TECHNICAL FIELD

The invention proceeds from an incandescent lamp having a carbide-containing luminous element and having supply leads that hold the luminous element, the luminous element being hermetically inserted in a bulb together with a filling, the luminous element having tantalum or a high-melting metal carbide whose melting point is, in particular, above that of tungsten. In particular, what is involved are halogen incandescent lamps which have a luminous element made from TaC, or whose luminous element contains TaC as a constituent or coating.

BACKGROUND ART

An incandescent lamp having a carbide-containing luminous element is known from many documents. An as yet unsolved problem is the brittleness of such a luminous element, something which greatly limits the service life. It is true that a possibility mentioned in U.S. Pat. No. 3,405,328 consists in dissolving the carbon in excess in the tantalum carbide luminous element. The carbon evaporated to the outside by the luminous element and which is deposited on the bulb wall is then replaced by diffusion from the interior outward.

A further possibility constitutes the addition of carbon and hydrogen to the filling gas, see U.S. Pat. No. 2,596,469, for example. A cyclic carbon process arises in this case in the lamp. The carbon evaporated at high temperatures reacts at lower temperatures with hydrogen to produce hydrocarbons which, through convection and/or diffusion, are transported back to the filament where they decompose again. The carbon produced in the process is adsorbed again onto the filament. It is mostly necessary to use a hydrogen excess for a functioning cyclic carbon process, in order to avoid the deposition of carbon (in the form of carbon black) in the lamp vessel. The filament made from carbide which is used here is fastened on supply leads by crimping, for example.

In order to reduce the efficiency loss, in addition to hydrogen use has also been made of halogens for reaction with the carbon, see U.S. Pat. No. 3,022,438, for example. Here, the luminous element is fastened similarly on a frame. The carbon evaporated by the luminous element reacts in the cold regions near the bulb wall with, for example, chlorine atoms to form compounds such as $CCl_4$, deposition of the carbon on the wall thereby being avoided. The carbon/halogen compounds are transported back in the direction of the incandescent element by transport processes such as convention and diffusion, decomposing in the warmer region and releasing the carbon in the process. The carbon can be adsorbed again onto the filament.

DISCLOSURE OF THE INVENTION

It is an object of the present invention to provide an incandescent lamp having a carbide-containing luminous element and having supply leads that hold the luminous element, the luminous element being hermetically inserted in a bulb together with a filling, the luminous element having tantalum or a high-melting metal carbide whose melting point is, in particular, above that of tungsten, in particular having a halogen filling, which permits a long service life and overcomes the problem of the brittleness of the luminous element.

These objects are achieved by the following means: The supply leads are fabricated integrally with the luminous element from a wire, and at least a portion of one supply lead is sheathed by a coating, in particular an electrically conducting one. Particularly advantageous refinements are to be found in the dependent claims.

According to the invention, use is made for this purpose of an integral luminous element in the case of which the two supply leads are a continuation of the coiled luminous element. The luminous element and supply lead are formed from a single wire.

The invention described here relates, in particular, to lamps having a reduced bulb volume, the distance of the luminous element, in particular the luminous sections thereof, from the inner wall of the bulb being at most 18 mm. In particular, the bulb diameter is itself at most 35 mm, in particular in the range between 5 mm and 25 mm, preferably in the range between 8 mm and 15 mm. It is mandatory to oppose the risk of deposition of solids on the bulb wall in the case of bulbs with such small dimensions, in particular with so small diameter. Depending on the color temperature of the filament, the bulb blackening can be substantially reduced or avoided in the case of these small bulb diameters via a twofold cyclic process as described in the as yet unpublished DE-A 103 56 651.1.

In a preferred embodiment, at least one supply lead is stabilized by virtue of the fact that it is sheathed at least partially by a coating which is electrically conducting, in particular. The two supply leads are preferably sheathed at least partially by a filament or a winding, frequently termed coating filament below. An alternative is a compact sleeve made from an electrically conducting material, in particular from metal such as tungsten, or from cermet, or from carbon, which can likewise be electrically conducting as already known from carbon filament lamps, but graphite or diamond is also suitable as coating.

In particular, what is involved is a luminous element, arranged axially or transverse to the axis, in a bulb sealed at one or two ends, in particular pinched. The coating filaments are preferably fabricated from a high-temperature-resistant, non-carbide-containing material, in particular from tungsten. Tantalum or molybdenum also come into consideration. Alternatives are electrically conducting cermets as sleeves. It is essential to have a sufficiently small electrical resistance which is to be smaller, in particular substantially smaller, advantageously at least 50% smaller than that of the luminous element, in order in this way to improve the low make-proofness of simple luminous elements or incandescent filaments which are constructed from luminous elements and feeders. This is important chiefly when the feeders have the same diameter of the wire as does the luminous element itself. A high resistance and the frequent burnout, associated therewith, of carbide-containing luminous elements, precisely in the region of the pinched edge, are therefore avoided. In the extended sense, a carbide-containing luminous element is also understood here in particular as a tantalum-containing luminous element, and not only as a tantalum carbide-containing one.

The luminous element is preferably a singly wound wire whose ends, which serve as supply leads, are not wound. 50 to 300 μm are typical diameters of the wire for the luminous element. The luminous element is typically formed from 5 to 20 turns. 1.4 to 2.8 is a preferred pitch factor for achieving the highest possible stability of the luminous element.

It is particularly preferred for the coating filament to extend onto the region of the supply lead which enters the bulb material from the interior of the bulb.

The bulb is normally sealed by one or two pinches. This region is denoted as pinched edge. Moreover, the susceptibility to fracture is particularly high precisely in the region of the pinched edge, since a high bending moment occurs here.

It is particularly preferred for the coating filament to extend over approximately at least 10%, preferably at least 50%, with particular preference over at least 80% of the length of the supply lead in the interior of the bulb, in particular over the entire length, because in this way a higher stability is achieved against distortion of the alignment of the luminous element, this being the so-called filament deformation. The coating filament serves in this case as support at the same time.

This aspect is particularly significant because the concept of the axial luminous element is well suited in principle for fitting on the bulb a coating which raises efficiency. A so-called infrared coating (IRC) such as is described, for example, in U.S. Pat. No. 5,548,182 is known. In accordance therewith, it is also possible to adapt the bulb specifically therefor. For example, it can be of elliptical or cylindrical shape, as is known per se.

A particular advantage is effected by the application of halogen fillings, since given suitable dimensioning it is possible to institute a cyclic process not only for the material of the luminous element, but also for the material of the coating filament. Such fillings are known per se. In particular, what is involved here is a filling for a twofold cyclic process such as is described in the as yet unpublished DE-A 103 56 651.1.

In particular, the invention also exhibits clear advantages as against luminous elements with massive supply leads, so-called electrode holders, which have so far been used almost exclusively as a holding device for carbide-containing luminous elements. The inventive design achieves a substantially higher shockproofness (it withstands an acceleration of more than 100 g, in particular even more than 300 g) compared with a frame that uses electrode holders and which achieves a shockproofness of only approximately 40 g. The supply leads consisting of thin wire can absorb the impact energy more effectively without fracturing than can comparatively thick and stiff electrode holders. The impact energy can thus be dissipated by elastic resilience of the entire luminous element.

Moreover, the inventive design is clearly simpler than previous designs, because no quartz beam is required, and because there is also no need for any problematical contacts between the luminous element and the supply leads (making contact by welding or clamping and/or crimping is typical). These contacts frequently cause damage to the ends of the luminous element, the so-called filament feeders. They also likewise reduce the shockproofness of the lamp.

The material of the luminous element is preferably Ta, TaC or $Ta_2C$. However, carbides of Hf, Nb or Zr are also particularly suitable. Their melting points are either near or even above the melting point of tungsten.

The present invention is particularly suitable for low voltage lamps with a voltage of at most 50 V, because the luminous elements required therefor can be of relatively massive design. For this purpose, the wires can preferably have a diameter of between 50 μm and 300 μm, in particular at most 150 μm for general illuminating purposes with a maximum power of 100 W. Thick wires of up to 300 μm are used, in particular, for photooptical applications up to a power of 1000 W.

It is particularly preferred to use the invention for lamps pinched at one end, since here the luminous element can be kept relatively short, and this likewise reduces the susceptibility to fracture.

A further parameter in the optimization of the impact strength is the weight of the luminous element. It should be as small as possible taking account of the illumination values. Finally, the length of the filament feeders is also important. The longer the filament feeder, the more sensitive it is with regard to fracture at the pinched edge. Its maximum length should as far as possible not exceed 25 mm.

TaC or W should preferably be used as material for the luminous element or the coating filament. The diameter of the wire of the coating filament should be, in particular, between 30 and 95% of the diameter of the wire of the luminous element. The pitch factor of the coating filament should be between 1.0 and 2.0. The coating filament or coating sleeve can consist of electrically conducting cermet, carbon or else tungsten or a similarly high-melting metal.

BRIEF DESCRIPTION OF THE DRAWINGS

The invention is to be explained in more detail below with the aid of a number of exemplary embodiments. In the drawing.

BEST MODE FOR CARRYING OUT THE INVENTION

Figure 1:
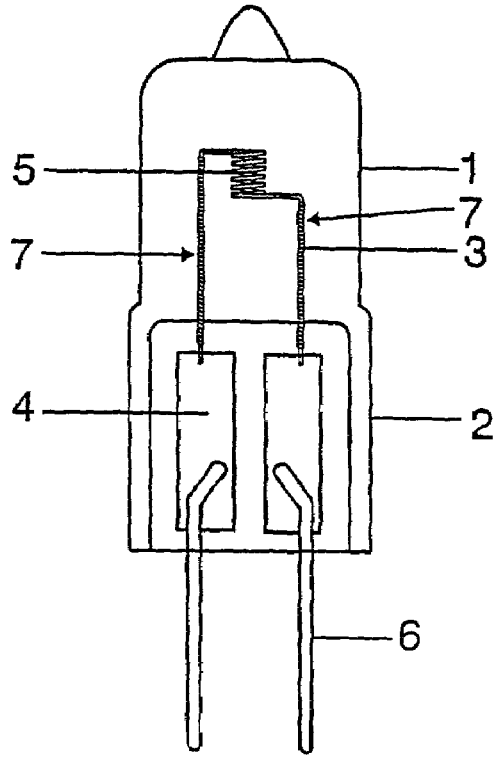
FIG. 1 shows an incandescent lamp having a carbide luminous element in accordance with a first exemplary embodiment.

FIG. 1 shows an incandescent lamp pinched at one end having a bulb made from silica glass 1, a pinch 2, and inner supply leads 3, which connect foils 4 in the pinch 2 to a luminous element 5. The luminous element is a singly wound wire made from TaC. The outer supply leads 6 are fastened on the outside to the foils 4. The inner diameter of the bulb is 5 mm. The filament ends are bent away parallel to the lamp axis and stabilized over their entire length with the aid of a coating filament 7. This consists of a narrowly wound wire made from tungsten.

Figure 2:
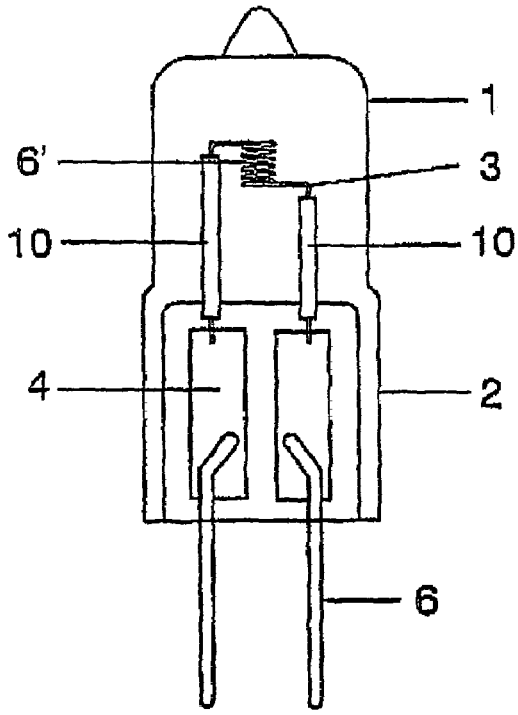
FIG. 2 shows an incandescent lamp having a carbide luminous element in accordance with a second exemplary embodiment.

FIG. 2 shows an incandescent lamp pinched at one end and having a bulb made from hard glass 1, a pinch 2, and inner supply leads 3, which are connected to a luminous element 6'. A coating 10 is used for the supply leads 3. It is a sleeve made from electrically conducting cermet that covers approximately 80% of the length of the supply leads 3 and still reaches into the pinch. Such an electrically conducting cermet is known, for example, from EP-A 887 840 or U.S. Pat. No. 4,155,758 and the prior art discussed therein. A particular example is a cermet with a content of 50% by volume of molybdenum, the remainder being aluminum oxide. The luminous element 6' is a wound wire having a core made from rhenium and a layer of TaC on the surface. This luminous element can be more easily deformed than a luminous element consisting purely of carbide. In this case, the rhenium wire is mostly firstly wound, and a TaC layer is subsequently applied. The outer supply leads 6 are fastened on the outside directly to the foils 4, specifically in the region of the pinch. The inner diameter of the bulb is 30 mm. Alternatively, the luminous element is a flexible lead made form carbon fibers that are coated with tantalum. The TaC layer can be produced, for example, by applying a tantalum layer using a CVD method, or by sputtering on followed by carburization. The carburization of the Ta layer can also not be carried out until during operation of the lamp in an atmosphere containing hydrocarbons.

Figure 3:
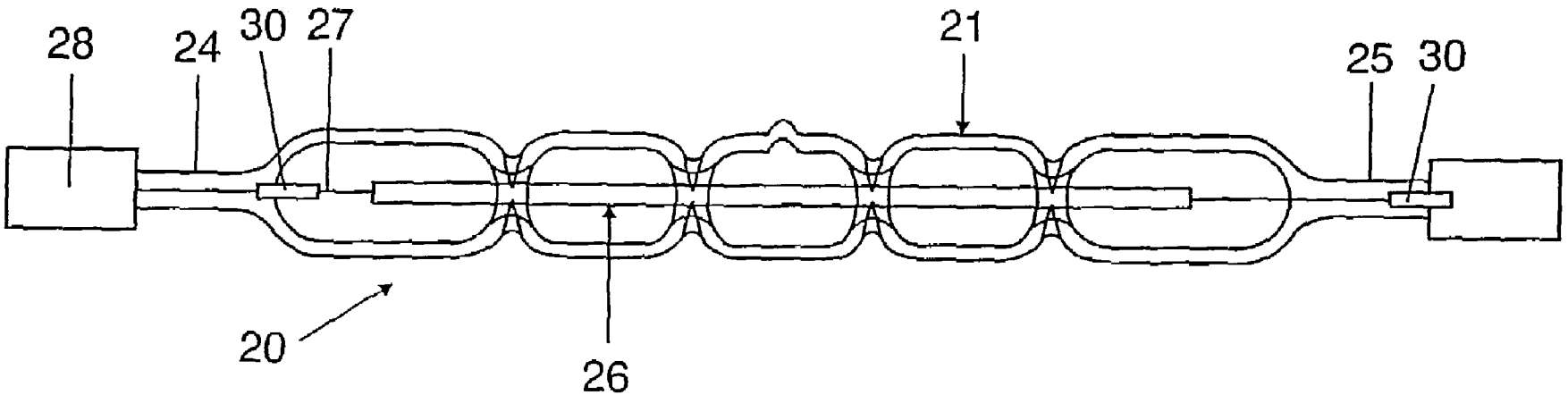
FIG. 3 shows an incandescent lamp having a carbide luminous element in accordance with a third exemplary embodiment.

FIG. 3 shows an incandescent lamp 20 pinched at two ends, also known as a tubular lamp, having a bulb made from silica glass 21, two pinches 24 and 25, and supply leads 27 which are connected to a luminous element 26. The luminous element 26 is singly wound and consists of TaC. The supply leads 25 are sheathed with a sleeve 30 made from molybdenum and end in base parts 28 which, as is known per se, are seated on the pinch. The inside diameter of the bulb is 15 mm.

In general, the lamp preferably uses a luminous element made from tantalum carbide, which preferably consists of a singly wound wire.

The bulb is mostly fabricated from silica glass or hard glass with a bulb diameter of between 5 mm and 35 mm, preferably between 8 mm and 15 mm.

The filling is chiefly inert gas, particularly noble gas such as Ar, Kr or Xe, if appropriate with the admixture of small amounts (up to 15 mol %) of nitrogen. Present in addition are a hydrocarbon, hydrogen and a halogen additive.

Also suitable as material for the luminous element are zirconium carbide, hafnium carbide or an alloy of various carbides such as described in U.S. Pat. No. 3,405,328, for example.

One alternative is a luminous element that consists of a carrier material such as a rhenium wire, for example, as core, or else of a carbon fiber, this core being coated with tantalum carbide or another metal carbide.

A carbon content of 0.1 to 2 mol % serves as a guide for the filling. The hydrogen content is equal to at least the carbon content, preferably to twice to eight times the carbon content. The halogen content is equal to at most half, in particular a fifth to a tenth of the carbon content. The halogen content should preferably correspond at most to the hydrogen content, preferably at most to half the hydrogen content. 500 to 5000 ppm is a guide for the halogen content.

Particular investigations are presented for a 24 V/100 W lamp. Its color temperature is 3800 K. It uses a TaC wire (obtained from carburized tantalum) with a diameter of 125 μm. This is singly wound and exhibits a markedly better fracture behavior than an otherwise identical luminous element made from a wire with a 190 μm diameter. The fracture tests were carried out with an impact pendulum.

What is decisive is the lower weight of the thinner luminous element, which causes a lower impulse on the filament feeders. This is seen in the comparison of two luminous elements made from the same wire, of which one luminous element has six, and the other luminous element has eight turns. The shorter wire with the lower weight is clearly less susceptible to fracture.

By contrast, an identical lamp that, however, uses the customary stiff electrode holders made from molybdenum is substantially more susceptible to fracture. Only the luminous elements provided with a coating are suitable for the transportation of the lamp under normal conditions. In the case of other concepts, the luminous element is so susceptible to fracture that special measures must be taken for the transportation of the lamp.

The longer the filament feeders, which are, in particular, defined by the distance of the luminous element from the pinched edge, the more sensitive is the Ta/Ta carbide luminous element. Pure Ta is present in the pinch up to the pinched edge, frequently Ta2C is present in the feeders, and TaC is present in the luminous element itself. The maximum length in the bulb should not exceed 25 mm, in particular.

Additionally, there is a reduction in the deformation of the luminous element the shorter that the filament feeders are chosen. The cause of the deformation is the increase in volume during carburization. This increase becomes notable, in particular, owing to an increase in length. It has emerged that the disturbing deformation does not lead to tilting inside the turns of the luminous element, but that the luminous element as a whole tilts laterally from the axial position. The extensive avoidance of deformation is an unconditional precondition for the use of interference filters on the bulb in a sense of an IRC coating, as is known per se—see EP 765 528.

It has emerged, in addition, that a directly pinched-in Ta filament feeder without a coating filament made from tungsten can lead during the carburization process to glass cracks in the region of the pinched seal and thus to leaks in the lamp. The reason for this is the bonding of the Ta wire (expansion coefficient of $6.5\times10^{-6}$ $K^{-1}$) to the silica glass (expansion coefficient of $0.5\times10^{-6}$ $K^{-1}$).

The outside diameter of the sleeve corresponds at most to twice the diameter of the wire of the luminous element. The thinner the sleeve, the lower its weight.

With this in mind, it goes without saying that the coating is applied directly to the supply lead in a fashion bearing as closely as possible. However, it is not expressly excluded for there to be a spacing and additional introduction of mass by means of an auxiliary support further pushed into the coating in the form of an additional wire as in U.S. Pat. No. 3,355,619. On the one hand, this additional wire can act as an additional auxiliary support. On the other hand, additives or the complete filling gas admixture for the filling gas cyclic process can be introduced into the lamp at the filament feeders in solid form, for example coated carbon fiber or plastic fiber from halogenated hydrocarbon compounds.

A very particular filling for a lamp with a bulb diameter of 10 mm and a luminous element made from TaC consists of the following components: 1 bar (cold filling pressure) Kr+1% $C_2H_4$+1% $H_2$+0.05% $CH_2Br_2$. The concentrations given are in mol %.

What is claimed is:

1. An incandescent lamp comprising:

a carbide-containing luminous element and having supply leads that hold the luminous element, the luminous element being hermetically inserted in a bulb together with a filling, the luminous element having tantalum or a high-melting metal carbide whose melting point is, in particular, above that of tungsten, wherein the supply leads are fabricated integrally with the luminous element from a wire, and in that at least a portion of one supply lead is sheathed by an electrically conducting coating.

2. The incandescent lamp as claimed in claim 1, wherein the luminous element is a singly wound wire, in particular consisting of tantalum carbide at least on its surface.

3. The incandescent lamp as claimed in claim 1, wherein the bulb consists of silica glass or hard glass with a bulb diameter of between 5 mm and 35 mm.

4. The incandescent lamp as claimed in claim 1, wherein the filling contains inert gas, and an admixture of small amounts of nitrogen, as well as at least one hydrocarbon, hydrogen and at least one halogen additive.

5. The incandescent lamp as claimed in claim 1, wherein the luminous element is a singly wound wire, preferably with a diameter of 50 to 300 μm.

6. The incandescent lamp as claimed in claim 1, wherein the coating is a winding of a wire made from high-melting metal or carbon.

7. The incandescent lamp as claimed in claim 1, wherein the coating is a sleeve made from electrically conducting cermet, carbon or metal.

8. The incandescent lamp as claimed in claim 6, wherein the diameter of the wire of the coating is 30 to 95% of the diameter of the wire of the luminous element.

9. The incandescent lamp as claimed in claim 7, wherein the outside diameter of the sleeve is at most twice the diameter of the wire of the luminous element.

10. The incandescent lamp as claimed in claim 1, wherein the coating adheres directly to the supply lead.

11. The incandescent lamp as claimed in claim 3, wherein the bulb consists of silica glass or hard glass with a bulb diameter of between 8 mm and 15 mm.

12. The incandescent lamp as claimed in claim 5, wherein the luminous element is a singly wound wire, preferably with a diameter of 50 to 150 μm.

* * * * *